US006078666A

United States Patent [19]

Murakami

[11] Patent Number: 6,078,666

[45] Date of Patent: Jun. 20, 2000

[54] AUDIO SIGNAL PROCESSING METHOD AND RELATED DEVICE WITH BLOCK ORDER SWITCHING

[75] Inventor: Takashi Murakami, Osaka, Japan

[73] Assignee: Matsushita Electric Industrial Co., Ltd., Osaka, Japan

[21] Appl. No.: 08/958,238

[22] Filed: Oct. 27, 1997

[30] Foreign Application Priority Data

Oct. 25, 1996 [JP] Japan ..... 8-283750
Jun. 5, 1997 [JP] Japan ..... 9-147486

[51] Int. Cl.[7] ..... H04K 1/04

[52] U.S. Cl. ..... 380/37; 380/274; 380/276

[58] Field of Search ..... 380/19, 36, 7, 380/14, 48, 274, 276, 37

[56] References Cited

U.S. PATENT DOCUMENTS 4,600,941 7/1986 Sakamoto et al. ..... 358/121
4,683,586 7/1987 Sakamoto ..... 380/48
4,742,544 5/1988 Kupnicki ..... 380/14
4,905,278 2/1990 Parker ..... 380/7
5,058,159 10/1991 Quan ..... 380/19
5,321,748 6/1994 Zeidler et al. ..... 380/14
5,606,612 2/1997 Griffin et al. ..... 380/14

*Primary Examiner*—Gail O. Hayes
*Assistant Examiner*—Christopher M. Tucker
*Attorney, Agent, or Firm*—Ratner & Prestia

[57] ABSTRACT

An audio signal processing method and unit for scrambling and descrambling audio signals accompanying video signals. The audio signal processing method comprises steps of dividing digital audio signals into data blocks synchronized to video signals, and then switching the order of adjacent odd and even blocks. The audio signal processing unit comprises a synchronizing signal detector for detecting the synchronizing signal in the video signal; a timing controller for generating a sampling clock signal for A/D conversion, sampling signal for D/A conversion, and system clock from the synchronizing signal; an A/D converter for converting the analog audio signal to digital audio signal using the sampling clock for A/D conversion; a scrambler for dividing the digital audio signal into data blocks using the system clock and switching adjacent odd and even blocks; and a D/A converter for converting the output signal of the scrambler to the analog audio signal using the sampling clock for D/A conversion.

7 Claims, 15 Drawing Sheets

AUDIO SIGNAL PROCESSING METHOD AND RELATED DEVICE WITH BLOCK ORDER SWITCHING

FIELD OF THE INVENTION

The present invention relates to the field of methods or processing audio signals in video programs or audio signals accompanying video signals, and devices employing such methods. More specifically, the present invention relates to scrambling and descrambling methods for audio signals and devices employing such methods.

BACKGROUND OF THE INVENTION

Pay video program broadcasting and pay transmission services have recently started with the introduction of so-called scramble technology in various fields such as satellite television broadcasting and CATV systems. Similar technologies have also been adopted for packaged video programs such as video cassette tapes with respect to copyguard and copyright protection.

An example of audio signals in video programs recorded on cassette tapes (such as VHS and 8-mm tapes) which require scrambling is explained next. Passenger aircrafts are increasingly provided with liquid crystal television sets facing each seat, depending on the class of the seat. There is a system to allow the passenger to select a preferred program from the menu of the tape provided and play it back. If this cassette tape is removed by the passenger for their own use, there is a danger that the programs recorded on the cassette tape may be copied. Since airlines often provide new programs before or immediately after they are released to cinemas, to provide better service to passengers, copying of such new programs risks causing a serious problem. Thus, audio signals are scrambled before recording onto the tape so that sound cannot be reproduced with standard playback units.

Several audio signal scrambling and descrambling technologies have already been introduced. They all require large-scale circuitry and operation processing to be built into the main body of the video playback unit. For example, an audio scrambling and descrambling process may need to be incorporated in conventional signal processing for scrambling and descrambling the audio signal in VHS and 8-mm video tapes. This requires significant efforts Including redesigning of existing hardware (LSIs, ICs), large-scale software modifications, and testing and verification of system operations based on these changes.

SUMMARY OF THE INVENTION

The present invention offers a method for processing the analog audio signal and a signal processing unit for suppressing the noise which is likely to occur as a result of scrambling, and preventing deterioration of sound quality without requiring substantial changes in hardware or software The principle of the audio signal processing method of the present invention is as follows. First, an analog audio signal is converted to a digital audio signal using a clock pulse generated from a timing signal synchronized to the vertical synchronizing signal of the television or video signal. Then, data of the digitized signals is blocked into specified groups. Scrambling is applied to the data by switching the order of adjacent odd and even blocks. Conversely, for descrambling, the switched odd and even blocks are replaced in their original order for reproducing the original audio signal data.

Noise and deterioration of sound quality may occur near the boundary of each block due to the blocking process of the audio signal data and switching of the order of odd and even blocks. The present invention adds protection data before and after each data block boundary before scrambling to reduce noise and deterioration of sound quality caused by discontinuity around each block boundary.

DESCRIPTION OF THE PREFERRED EMBODIMENTS

First Exemplary Embodiment

Figure 1:
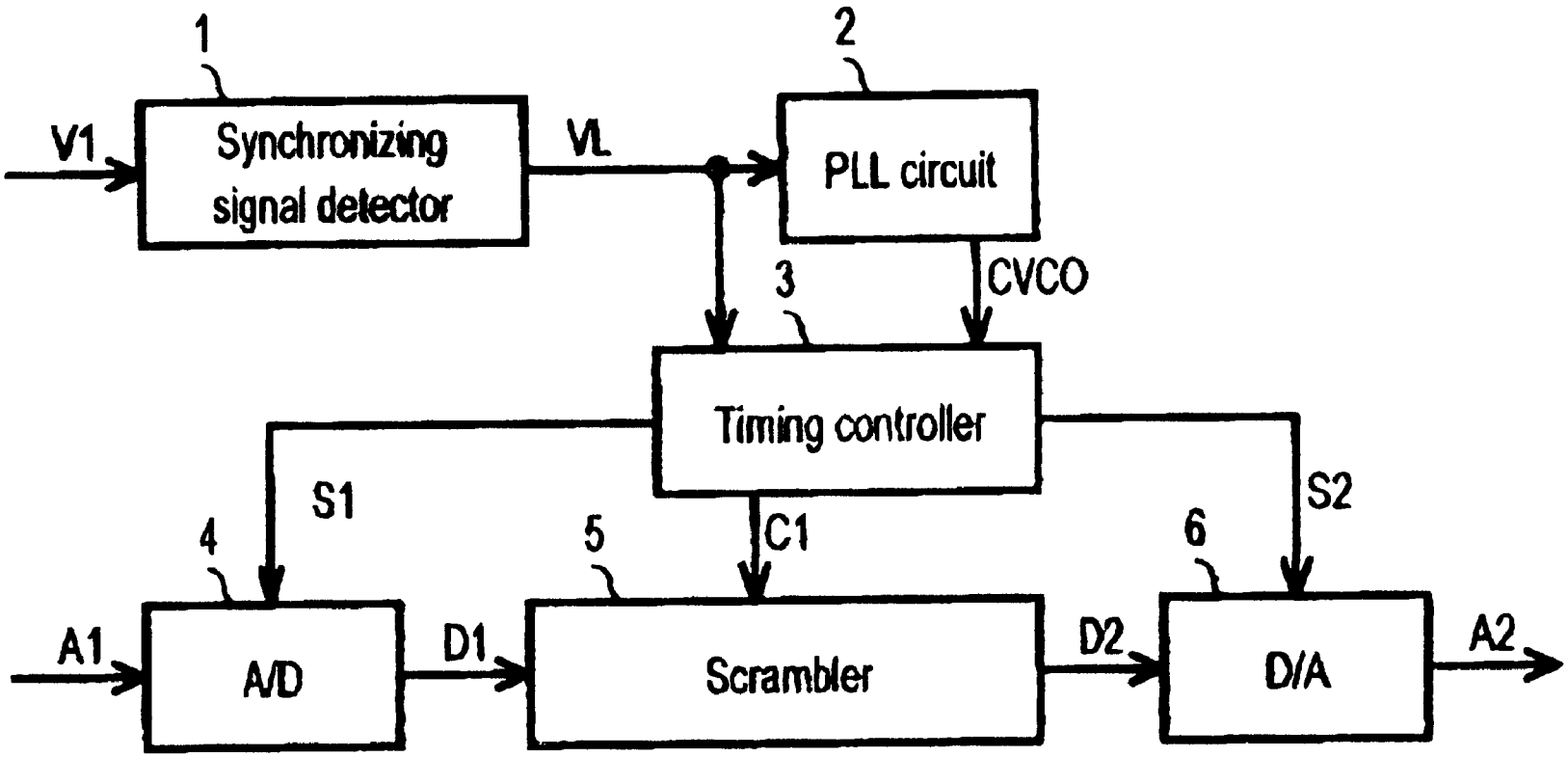
FIG. 1 is a block diagram for an audio signal processing unit in accordance with a first exemplary embodiment of the present invention.

FIG. 1 shows a block diagram of the part concerned with the audio signal processing unit for video programs in a first exemplary embodiment of the present invention.

In FIG. 1, a synchronizing signal detector 1 receives a video signal V1, extracts a vertical synchronizing signal VL, and supplies it to a PLL (Phase Locked Loop) circuit 2 which is one exemplary embodiment of a reference clock generator. The PLL circuit 2 generates a control reference clock signal CVCO by synchronizing the vertical synchronizing signal VL and a VCO (Voltage Controlled Oscillator). A timing controller 3 receives the output signal VL of the synchronizing signal detector 1 and the output signal CVCO of the PLL circuit 2, and outputs sampling clock signals S1 and S2, which are controlled to synchronize with the vertical synchronizing signal VL, and a system clock signal C1. The sampling clock signal S1 is supplied to an A/D converter 4.

Meanwhile, an analog audio signal A1 is also supplied to the A/D converter 4, and is converted to a digital audio signal D1 using the sampling clock signal S1 supplied from the timing controller 3. The A/D converter 4 outputs the digital audio signal D1 to a scrambler 5. In the scrambler 5, digital data of the digital audio signal D1 is blocked into a data block DB1 synchronized to the vertical synchronizing signal, as shown in FIG. 3B, using the system clock signal C1 supplied from the timing controller 3.

Figures 3A, 3B, 3C, 3D, 3E:
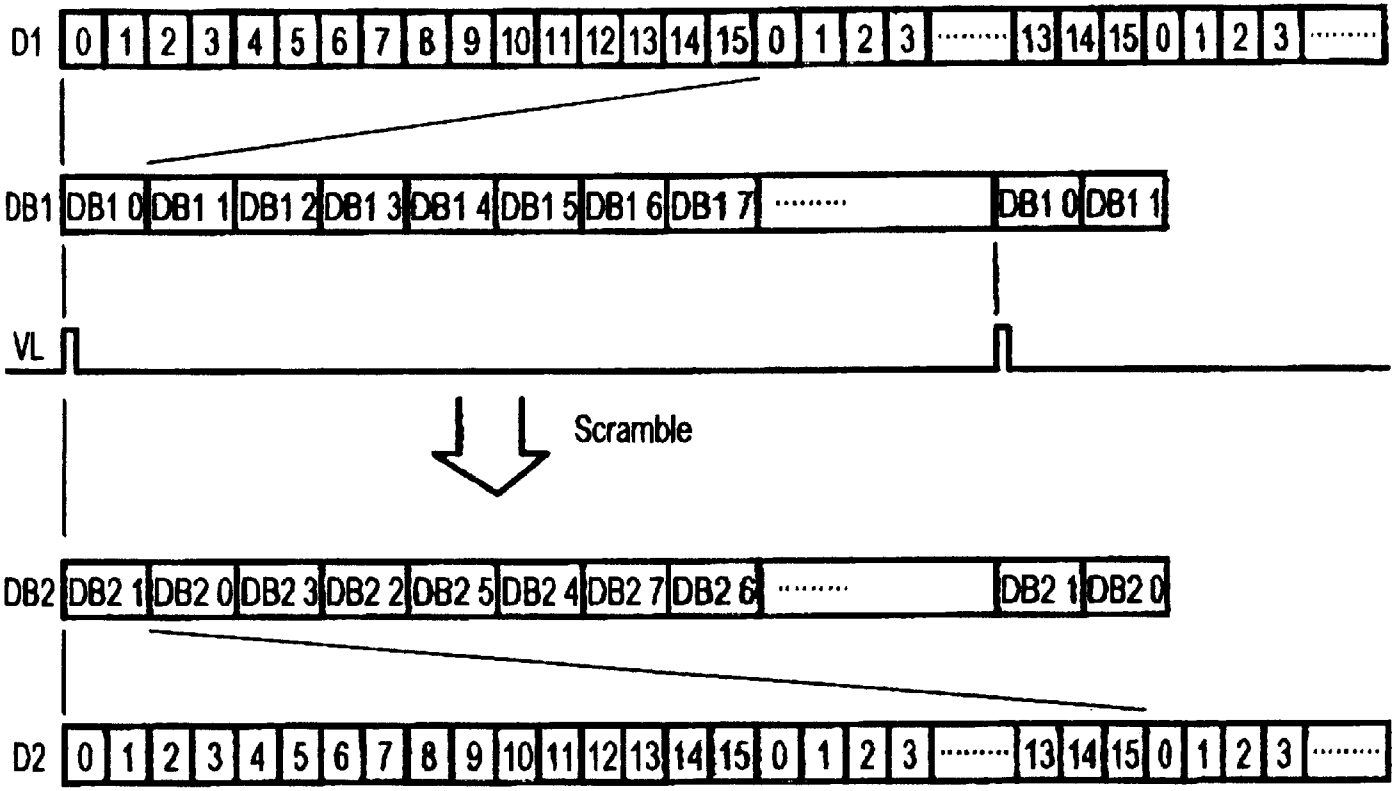
FIG. 3A is data array of the digital audio signal D1.
FIG. 3B it array of the data block DB1.
FIG. 3C is a vertical synchronizing signal VL.
FIG. 3D is a data block DB2 made from the data block DB1 by scrambling.
FIG. 3E is a digital audio signal D2 obtained by unblocking the data block DB2.

FIGS. 3A to 3E are an outline of data array of the digital audio signal during scrambling of the present invention. As shown in FIG. 3A, the digital audio signal D1 consists of data of 16 bits/sample. From the left end, 0 to 15 make 16 bits which represent one unit of data. A plurality of samples of this 16-bit data is grouped into one block. The data block DB1, as shown In FIG. 3B, is a group of more than one of these blocks in a vertical signal synchronizing period as shown in FIG. 3C.

The order of adjacent odd and even blocks of the data block DB1 grouped as explained above to switched in the scrambler 5 shown in FIG. 1, to form the data block DB2. For example, "DB1 0" and "DB1 1" of the data block DB1 shown in FIG. 3B are switched to "DB2 1" and "DB2 0" in the data block DB2 shown in FIG. 3D. The scrambling process of the present invention is achieved by switching the order of the data blocks as described above; the data is descrambled by recreating the original order of the switched data blocks.

Referring to FIG. 1 again, the scrambler 5 unblocks the block array of the data block DB2 for outputting a scrambled, but not blocked, digital audio signal D2 to a D/A converter 6. The D/A converter 6 converts the scrambled digital audio signal D2 to the scrambled analog audio signal A2 using the sampling clock signal S2 supplied from the timing controller 3, and outputs it. This scrambled analog audio signal is supplied to a conventional VHS or 8-mm video tape recorder together with the video signal.

Second Exemplary Embodiment

The principle of a descrambling method for reproducing the original audio signal from the analog audio signal A2 obtained by the above scrambling process is explained with reference to FIG. 2 which shows a block diagram for the part concerned with the descrambling process In a second exemplary embodiment of the present invention.

Figure 2:
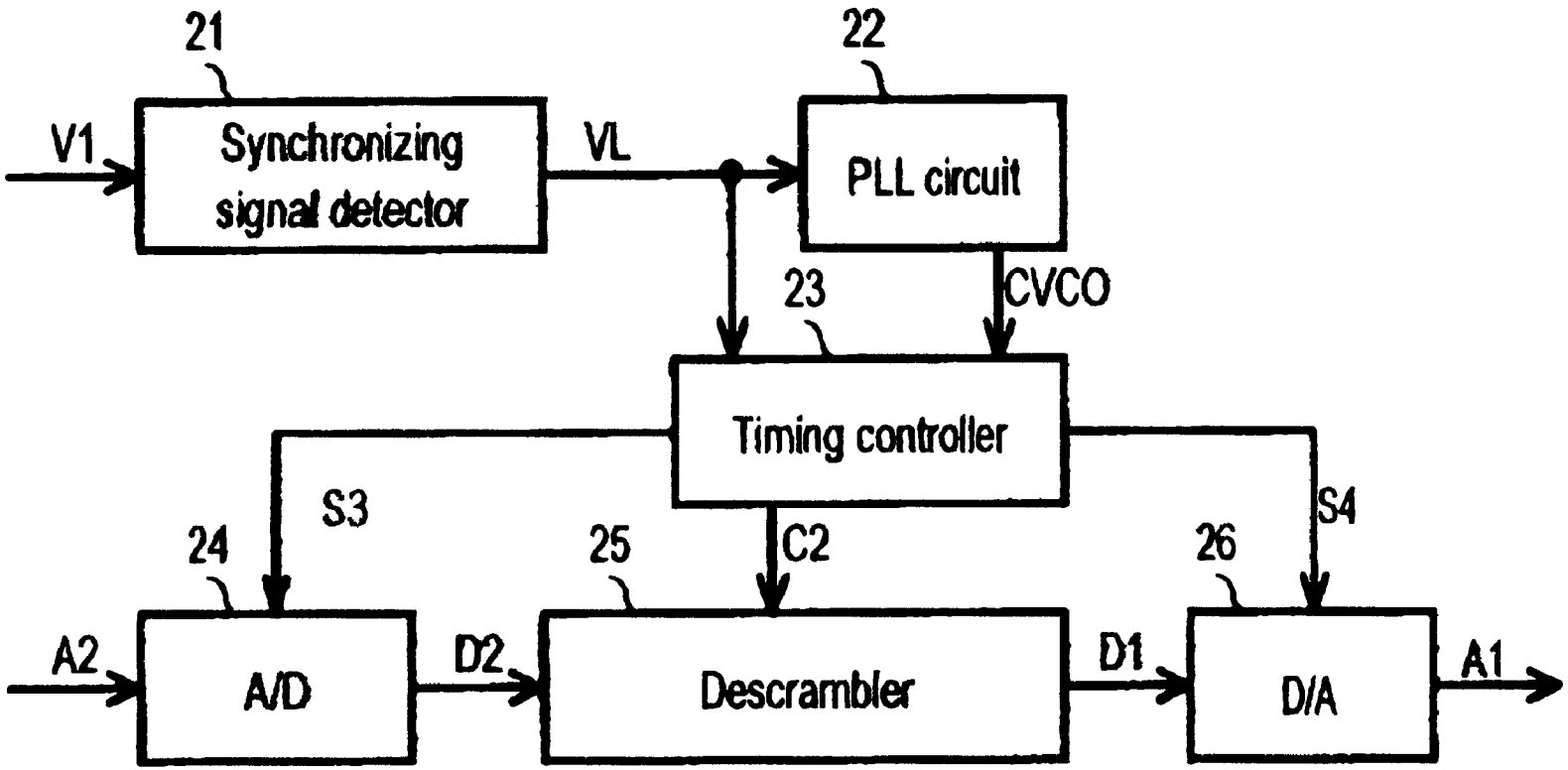
FIG. 2 is a block diagram for an audio signal processing unit in accordance with a second exemplary embodiment of the present invention.

In FIG. 2, a synchronizing signal detector 21 extracts the vertical synchronizing signal VL from the input video signal V1, and supplies it to a PLL circuit 22. The PLL circuit 22 generates the control reference signal CVCO synchronized to the vertical synchronizing signal as mentioned above, and supplies it to the timing controller 23. The timing controller 23 receives the vertical synchronizing signal VL from the synchronizing signal detector 21 and the output signal CVCO of the PLL circuit 22, and outputs sampling clock signals S3 and S4, which are controlled to synchronize with the vertical synchronizing signal VL, and a system clock signal C2.

Meanwhile, an A/D converter 24 receives the analog audio signal A2 scrambled as mentioned above, and converts the scrambled analog audio signal A2 to the scrambled digital audio signal D2 using the sampling clock signal S3 supplied from the timing controller 23. The A/D converter 24 supplies this scrambled digital audio signal D2 to a descrambler 25.

Logically, the descrambling process is the opposite of the scrambling process described in the first exemplary embodiment. More specifically, in FIG. 2, the descrambler 25 blocks the input scrambled digital audio signal D2 into the data block DB2 synchronized to the vertical synchronizing signal using the system clock signal C2 supplied from the timing controller 23. The descrambler 25 then switches back the order of adjacent odd and even blocks of the blocked data block DB2 to their order of the data block DB1. Blocks of the data block DB1 are unblocked to the digital audio signal D1, and it is output from the descrambler 25 to a D/A converter 26.

The D/A converter 26 converts the input digital audio signal D1 to the analog audio signal A1 using the sampling clock signal S4 supplied from the timing controller 23, and outputs the analog audio signal A1. In this way, the original analog audio signal is regained.

In the present invention, time deviation in sampling In the scrambling and descrambling processes can be prevented and the boundary of each data block can also be fixed by synchronizing the digital audio signal to the synchronizing signal of the video signal. Accordingly, data is assured in the unit of data block, although the scrambled analog audio signal is descrambled, and thus continuity of data is maintained.

Third Exemplary Embodiment

Figure 4:
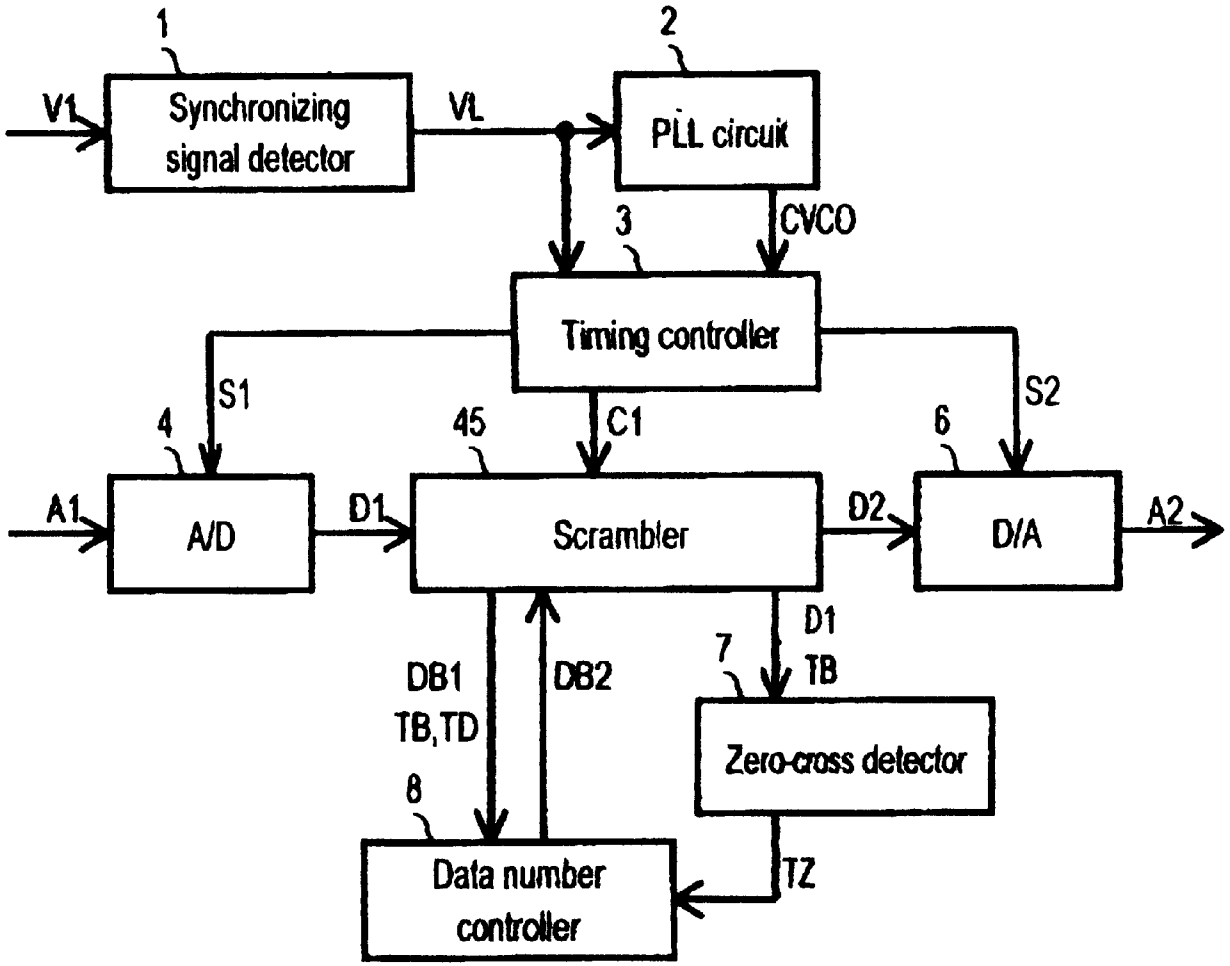
FIG. 4 is a block diagram for an audio signal processing unit in accordance with a third exemplary embodiment of the present invention.
Figures 5A, 5B:
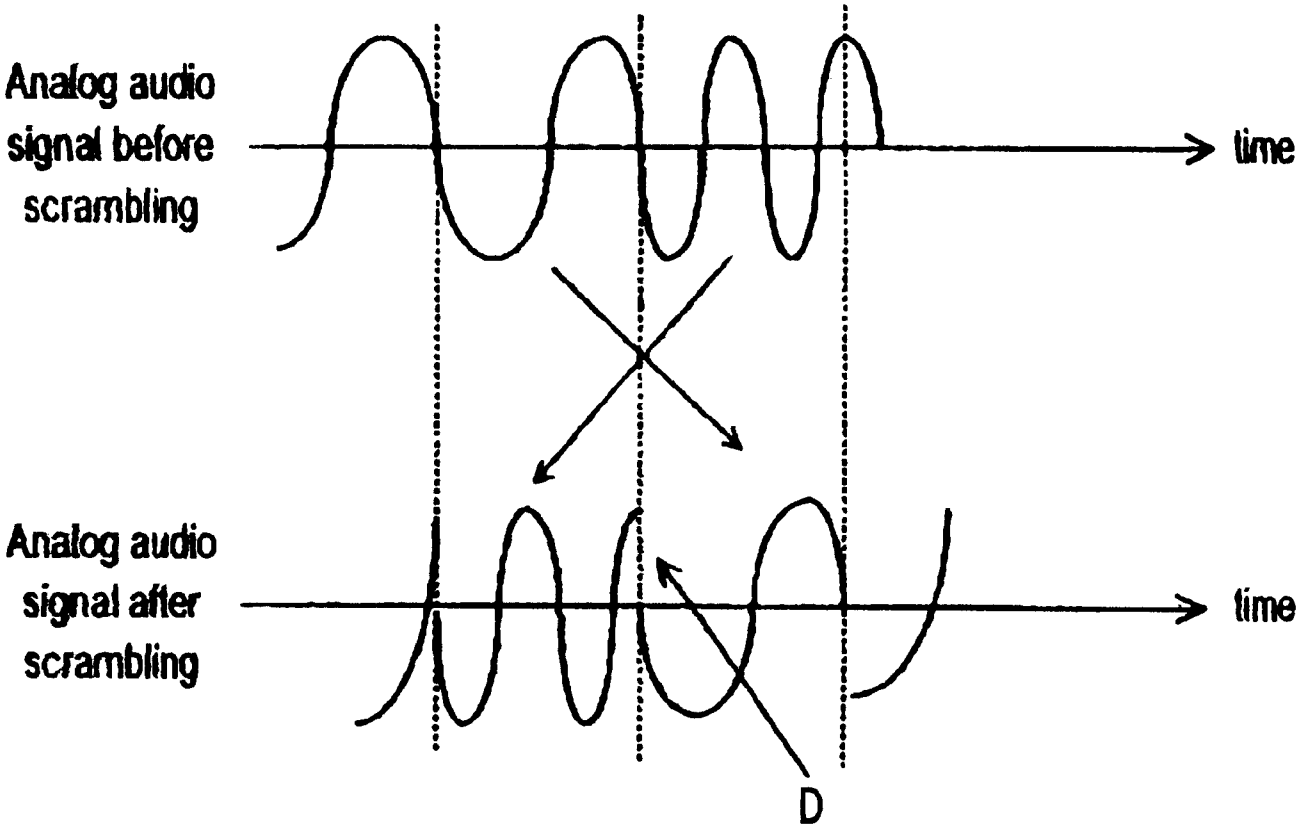
FIG. 5A is an example of analog audio signal waveform before scrambling.
FIG. 5B is an example of analog audio signal waveform after scrambling.

When the scrambled audio signal is descrambled to regain the original analog audio signal, as explained above, a data discontinuity occurs at the boundary of each block due to the blocking process as shown in FIG. 5B, causing noise which needs to be removed. FIGS. 5A and 5B show waveforms of the analog audio signal before and after scrambling. It is apparent that a discontinued segment D occurs in the waveform of the analog audio signal after scrambling. A third exemplary embodiment which suppresses noise caused by discontinuity in the audio signal occurring at the boundary of the data block, and prevents deterioration of sound quality is explained with reference to FIG. 4.

As shown in FIG. 4, the third exemplary embodiment comprises a zero-cross detector 7 and a data number controller 8 in addition to the configuration of the first exemplary embodiment shown in FIG. 1. The digital audio signal D1 is supplied to a scrambler 45 from the A/D converter 4, and is also supplied to the zero-cross detector 7. A fixed blocking time TB is also input to the zero-cross detector 7. The zero-cross detector 7 detects the time when the voltage of the digital audio signal D1 becomes zero (zero-cross point), and then calculates the zero-cross point which is closest to the boundary of the fixed blocking time TB for outputting a time TZ between the starting of the data block and this zero-cross point to the data number controller 8.

Figures 6A, 6B:
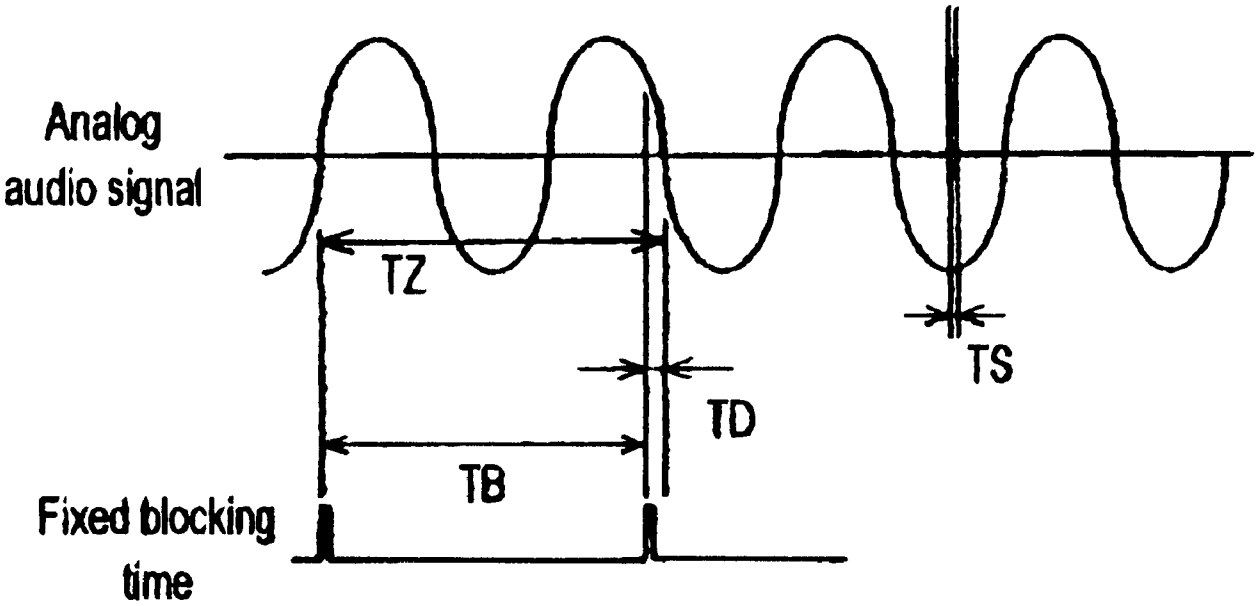
FIG. 6A is waveform of the analog audio signal for explaining blocking time.
FIG. 6B shows a blocking time width.

FIGS. 6A and 6B show waveforms of the analog signal illustrating the relation among the time TZ between the starting of the data block and the zero-cross point, the fixed blocking time TB, and the time difference TD=TZ−TB between the two. Discontinuity occurs due to the blocking process if the time difference TD exists, causing noise in the reproduced audio signal. To avoid this, the data number controller 8 processes the audio signal using the following procedures in this exemplary embodiment.

Figure 7:
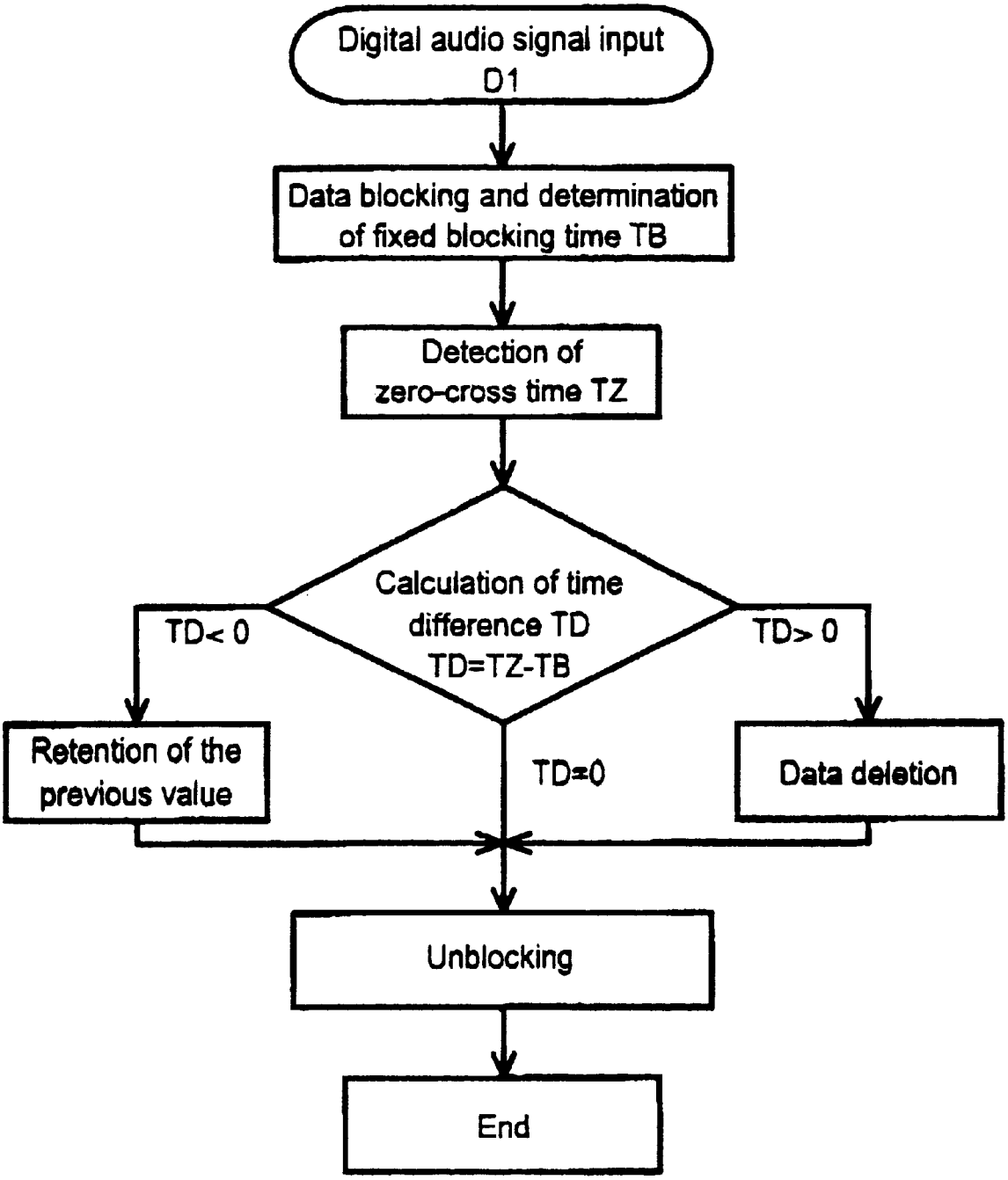
FIG. 7 is a flow chart of procedures for audio signal processing of the present invention.
Figure 8A:
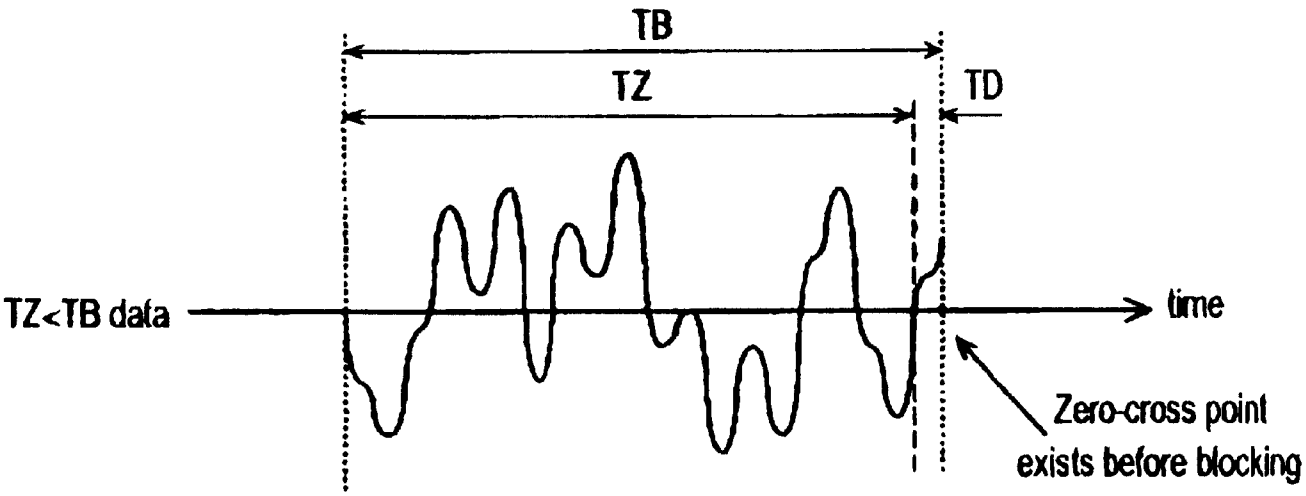
FIG. 8A is audio signal waveform before signal processing when TZ<TB.
Figure 8B:
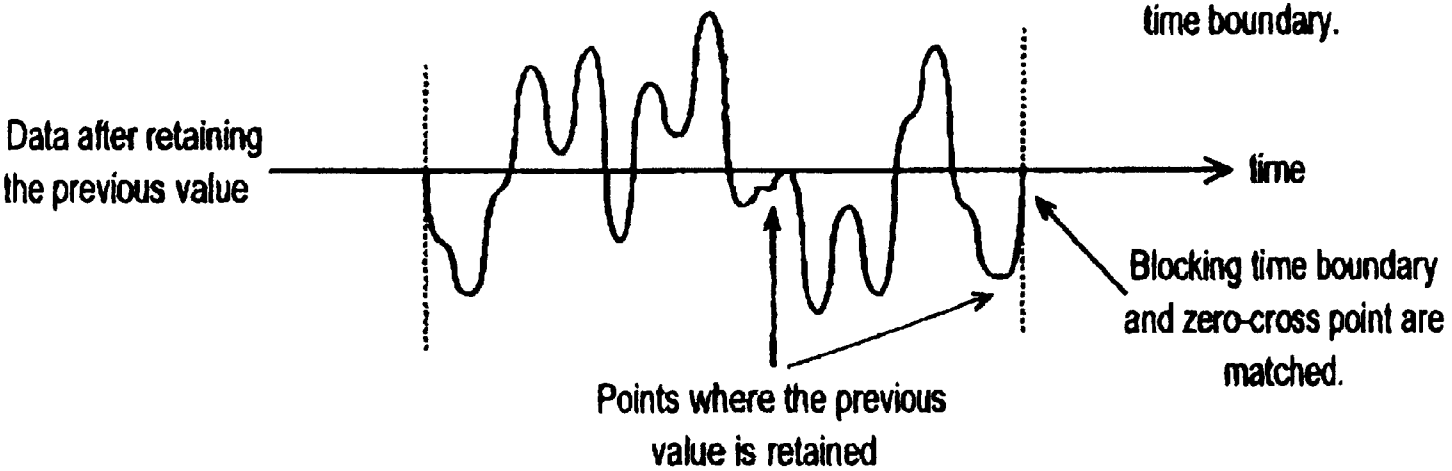
FIG. 8B is waveform after the previous value retaining processing is applied to the data with the waveform shown in FIG. 8A.

The data number controller 8 receives the aforementioned scrambled digital audio signal DB1 and the value of the fixed blocking time TB from the scrambler 45 in addition to the time difference TD. There are three processing methods depending on the size of the time difference TD as shown in the flow chart in FIG. 7. More specifically, when TD<0 (TZ<TB), i.e. when the time TZ from the starting of the data block to the zero-cross point is shorter than the fixed blocking time TB, the data number controller 8 forcibly inserts the data retaining the previous value to n points of the data block DB1 of the digital audio signal during the applicable blocking time TB if the time difference TD is n times a sampling time width TS. The data block DB1 after inserting the data retaining the previous value is fed back to the scrambler 45 as the data block DB2 of the digital audio signal. FIG. 8B is the waveform of the audio signal when the data retaining the previous value is forcibly inserted, compared to the waveform before such processing as shown in FIG. 8A.

Figures 9A, 9B, 9C:
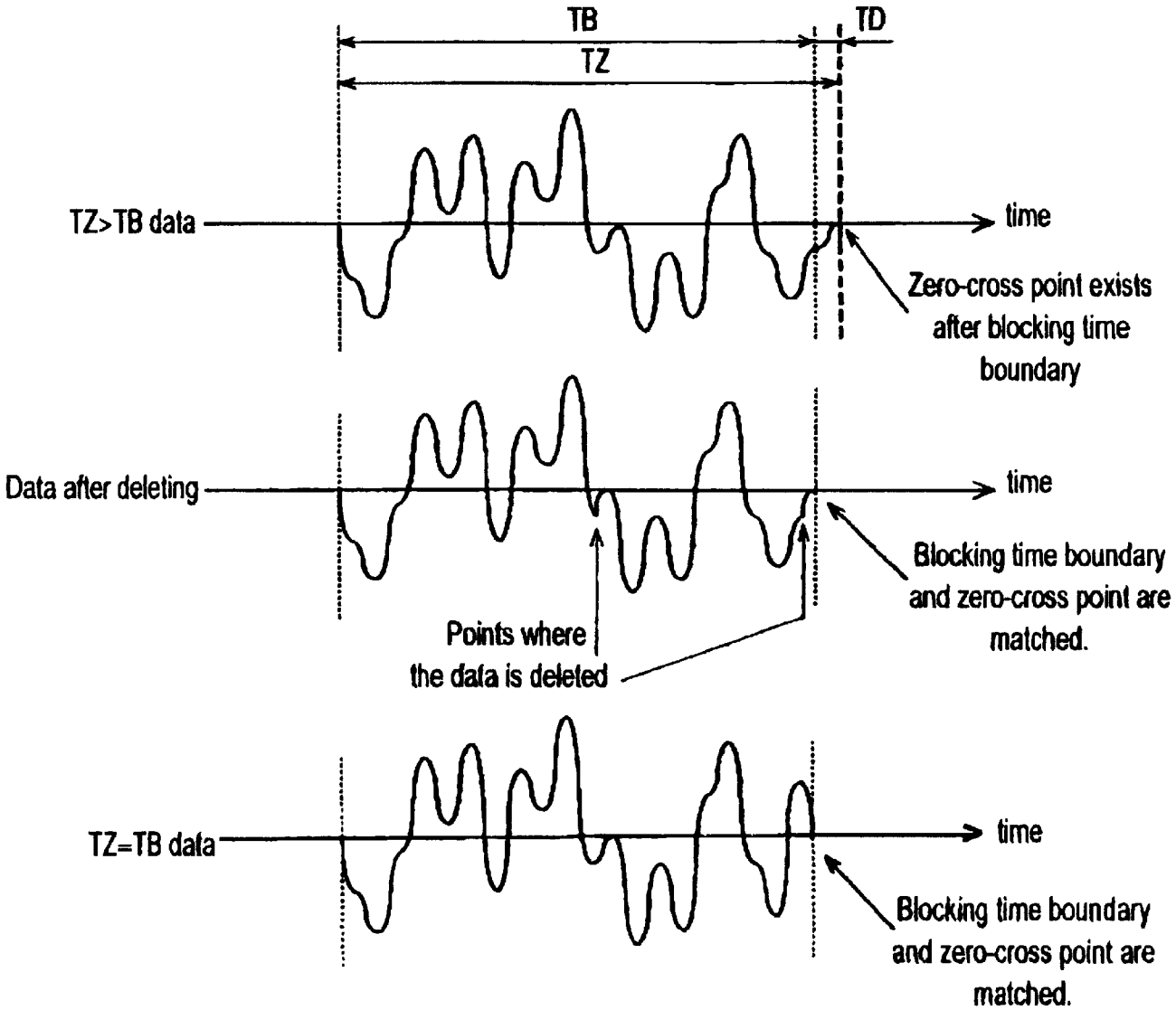
FIG. 9A is audio signal waveform before signal processing when TZ>TB.
FIG. 9B is waveform after deleting data from the data with the waveform shown in FIG. 8A.
FIG. 9C is audio signal waveform before signal processing when TZ=TB.

When TD>0, i.e. the time TZ from the starting of the data block to the zero-cross point is longer than the fixed blocking time TB, the data number controller 8 forcibly deletes data at n points of the data block DB1 of the digital audio signal in the applicable blocking time if the time difference TD is n times the sampling time width TS. The data block DB1 after deleting some data is fed back to the scrambler 45 as the data block DB2 of the digital audio signal. FIG. 9B is the waveform of the audio signal when such data is deleted, compared to the waveform of the audio signal before such processing as shown in FIG. 9A.

When TZ=TB, i.e. the time TZ from the starting of the data block to the zero-cross point is equal to the fixed blocking time TB, the data number controller 8 applies no processing to the data block DB1, and outputs it to the scrambler 45 as the data block DB2 of the digital audio signal. As for comparison with FIG. 7 and the waveforms in FIGS. 8A and 8B, the waveform of this audio signal is shown in FIG. 9C.

The data block DB2 processed in three ways an described above is scrambled instead of the data block DE1. In other words, the order of adjacent odd and even blocks of the data block DB2 obtained by the above processing is switched to create the data block DB2 in the scrambler 45 instead of switching the order of adjacent odd and even blocks of the data block DB1 of the audio signal as explained in the principle governing the scrambling method in the first exemplary embodiment of the present invention. The data block DB2 is then unblocked to form the digital audio signal D2, and is output from the scrambler 45.

In the waveform shown in FIG. 8B explaining processing of the retention of the previous value and the waveform shown in FIG. 9B explaining the processing of data deletion illustrate an example of processing at two points. It can also be processed at one point or at three or more points. However, it is preferable to apply retention of the previous value or data deletion dispersed over a plurality of points rather than applying all at a single point for reducing distortion in the waveform effectively.

Fourth Exemplary Embodiment

Figure 10:
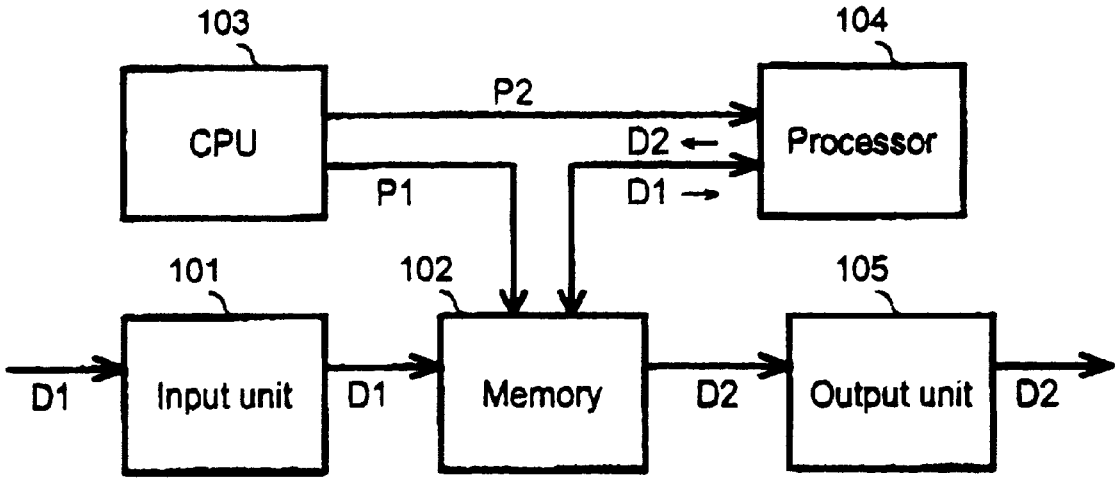
FIG. 10 is a block diagram for an audio signal processing unit in accordance with a fourth exemplary embodiment the present invention.

FIG. 10 shows a fourth exemplary embodiment of the present invention which realizes the above signal processing method. In FIG. 10, the digital audio signal D1 synchronized to the synchronizing signal of the video signal is input to a memory 102 through an input unit 101. The digital audio signal D1 is sent to a processor 104 after it is once stored in the memory 102 controlled by a control signal P1 supplied from a CPU (Central Processing Unit). The processor 104 divides the data of the digital audio signal D1 by a specified time to create the data block DB1.

Then, the data block DB1 is scrambled by switching its order of adjacent odd and even blocks as mentioned above to create the data block DB2. After scrambling, the data block DB2 is unblocked to create the scrambled digital audio signal D2 which is stored in the memory 102 and then output through an output unit 105.

Figure 11:
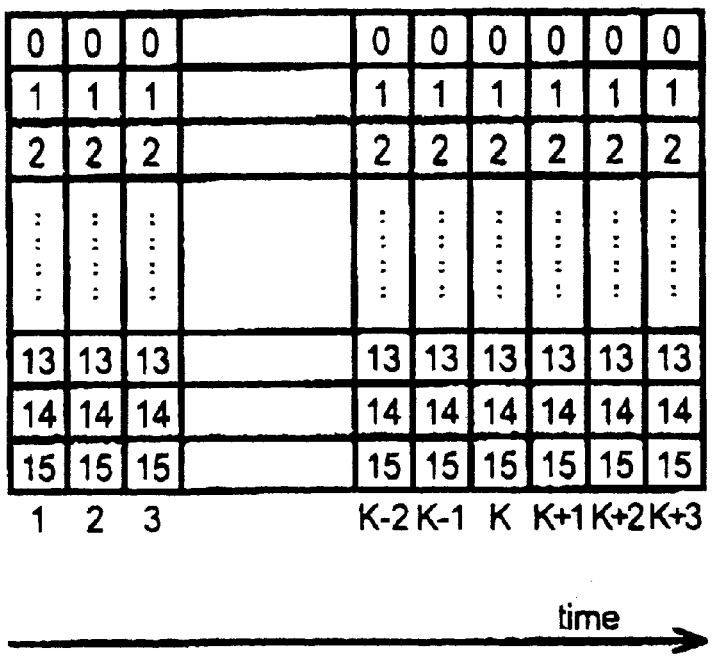
FIG. 11 is data structure in accordance with the fourth exemplary embodiment of the present invention.

FIG. 11 briefly shows an example of data structure stored in the memory 102. It illustrates that the 16 bits/sample digital audio signal, which is digitized by a sampling time TS along the time base, is stored in the memory 102 one by one. More particularly, the signal is stored in the order of sampling along the time base in rows and 16 (0 to 15) bits of each sample is stored in columns.

As mentioned above, this exemplary embodiment of the present invention detects the zero-cross point of the voltage level of the digital audio signal closest to the data block boundary of the audio signal, calculates the difference with the data block boundary, and retains the previous value in the data or deletes data for matching the data block boundary point and the zero-cross point in order to suppress noise occurring at the data block boundary.

Fifth Exemplary Embodiment

In the above signal processing method, however, the number of data units increases or decreases depending on retention of the previous value or deletion which is applied to match the data block boundary point and the zero-cross point. This may generate a little distortion in the waveform of the audio signal at points at which such processing is applied, causing deterioration in sound quality. A fifth exemplary embodiment of the present invention is effective for preventing deterioration in sound quality. A signal processing unit of the fifth exemplary embodiment adds protection data around data block boundary points before scrambling, where discontinuity occurs due to the blocking process, so that the discontinuity occurs at the point of the protection data.

Figure 12:
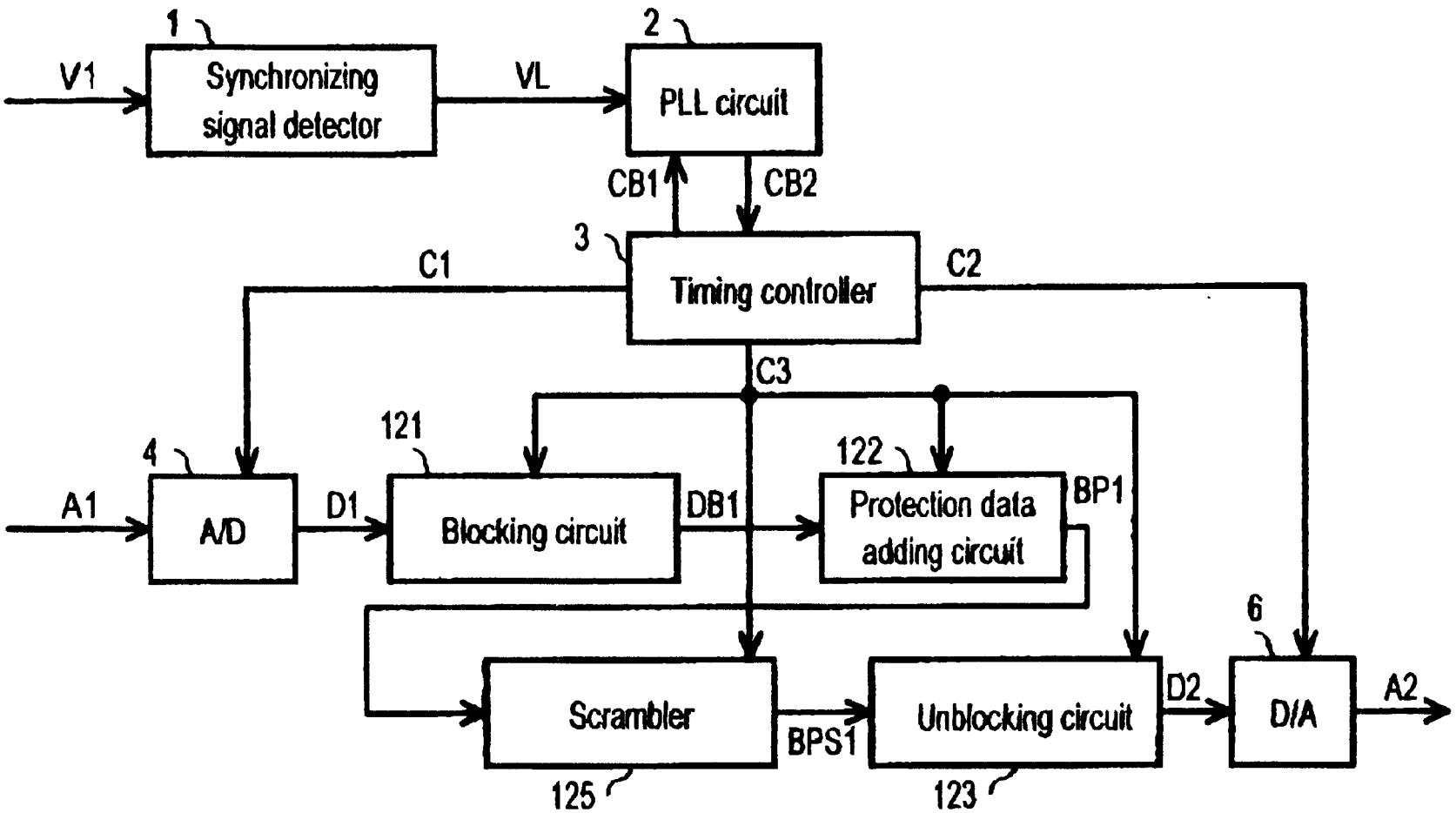
FIG. 12 is a block diagram for an audio signal processing unit in accordance with a fifth exemplary embodiment of the present invention.

FIG. 12 shows a block diagram for an audio signal processing unit in the fifth exemplary embodiment of the present invention. In FIG. 12, the synchronizing signal detector 1 detects the vertical synchronizing signal VL from the input video signal V1. The PLL circuit 2 generates a reference clock signal CB2 for signal processing by synchronizing a phase comparing clock signal CB1 supplied from the timing controller 3 to the vertical synchronizing signal VL, and supplies it to the timing controller 3. The timing controller 3 outputs a sampling clock signal C1 for A/D conversion, a sampling clock signal C2 for D/A conversion, and a system clock signal C3 for signal processing using the reference clock signal CB2 for signal processing. Here, the sampling clock signal C2 for D/A conversion is set to the frequency of ((n+2m)/n)×C1 to create an area for adding the protection data as explained below.

The A/D converter 4 converts the input analog audio signal A1 to the digital audio signal D1 using the sampling clock signal C1 for A/D conversion. The digital audio signal D1 is input to a blocking circuit 121, and the digital audio signal D1 is blocked to form the data block DB1, where an n number of data it grouped into one block. The data block DB1 output from the blocking circuit 121 is supplied to a protection data adding circuit 122.

The protection data adding circuit 122 adds an m number of digital audio signal data before and after each data block as the protection data as explained below. A data block BP1 after the protection data is added is supplied from the protection data adding circuit 122 to a scrambler 125.

The scrambler 125 scrambles the data block BP1 with protection data by switching the order of adjacent odd and even blocks, and outputs a scrambled data block BPS1 to an unblocking circuit 123.

The unblocking circuit 123 unblocks the input scrambled data block BPS1 to output the scrambled digital audio signal D2 to the D/A converter 6.

The D/A converter 6 converts the scrambled digital audio signal D2 supplied from the unblocking circuit 123 to a scrambled analog audio signal A2 using the sampling clock signal C2 for D/A conversion supplied from the timing controller 3, and outputs the scrambled analog audio signal A2.

The above processes for adding the protection data, blocking it, and scrambling the data block is explained with reference to brief data arrays in FIGS. 14A to 14E.

Figures 14A, 14B, 14C, 14D, 14E:
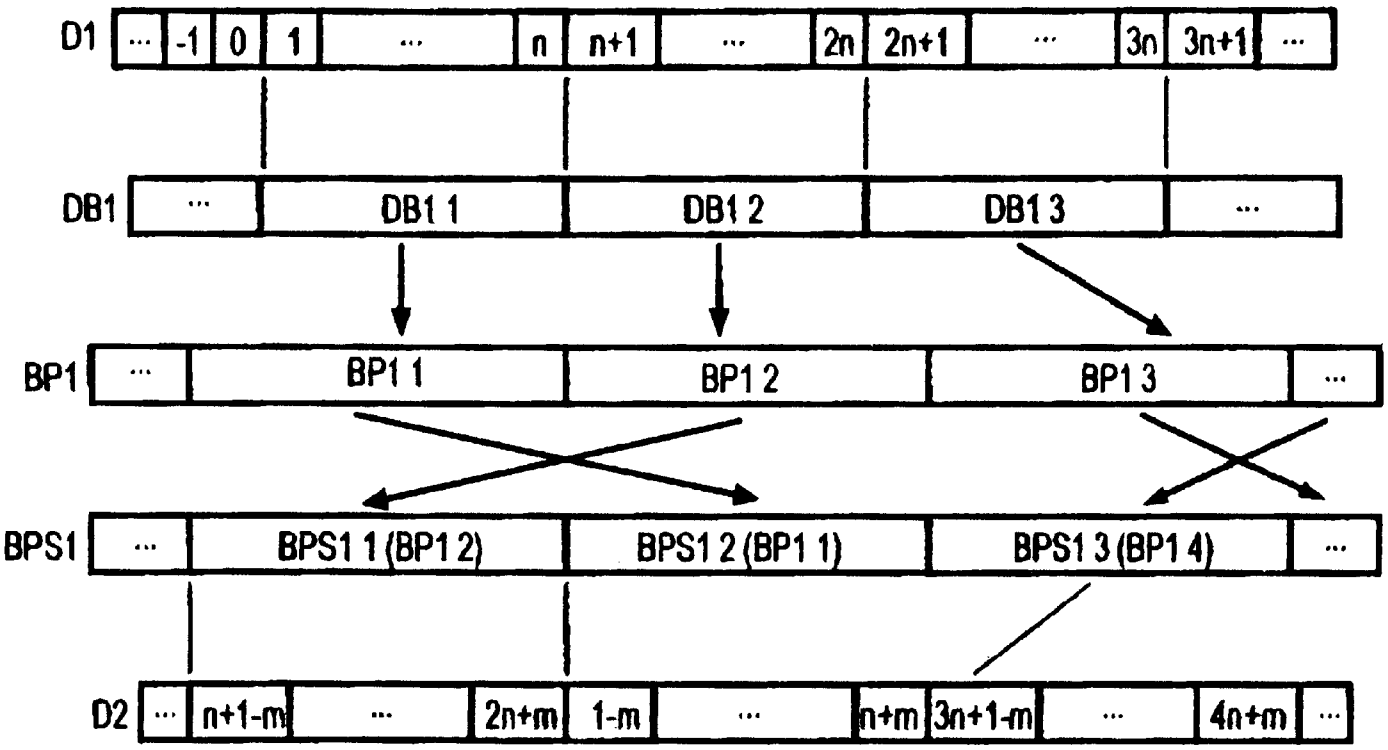
FIG. 14A is data array of the digital audio signal D1.
FIG. 14B is array of the data block DB1.
FIG. 14C is array of a data block BP1 after protection data is added.
FIG. 14D is array of a data block BPS1 obtained from scrambling the data block BP1.
FIG. 14E is data array of the digital audio signal D2 obtained from unblocking the data block BPS1.

FIG. 14A shows data array of the digital audio signal. FIG. 14B shows array of the data block DB1. For example, an n number of data from 1 to n shown in FIG. 14A is grouped into the data block "DB1 1" in FIG. 14B.

FIG. 14C shows the data block BP1 after the protection data in added. For example, an m number of protection data is added to before and after the data block "DB1 1" shown in FIG. 14B comprising an n number of data from 1 to n in FIG. 14A, to create "BP1 1." In the same way, an n number of data from (n+1) to 2n in FIG. 14A is grouped into a data block "DB1 2", and then blocked into a data block "BP1 2" shown in FIG. 14C.

FIG. 14D shows array of a scrambled data block BPS1. In other words, the order of the odd block "BP1 1" and adjacent even block "BP1 2" in FIG. 14C is switched to "BPS1 1 (BP1 2)" and "BPS1 2 (BP1 1)". The same shuffling process is implemented for the remaining for scrambling.

FIG. 14E shows data array of the scrambled digital audio signal D2 after unblocking the scrambled data block BPS1 shown in FIG. 14D.

Sixth Exemplary Embodiment

Figure 13:
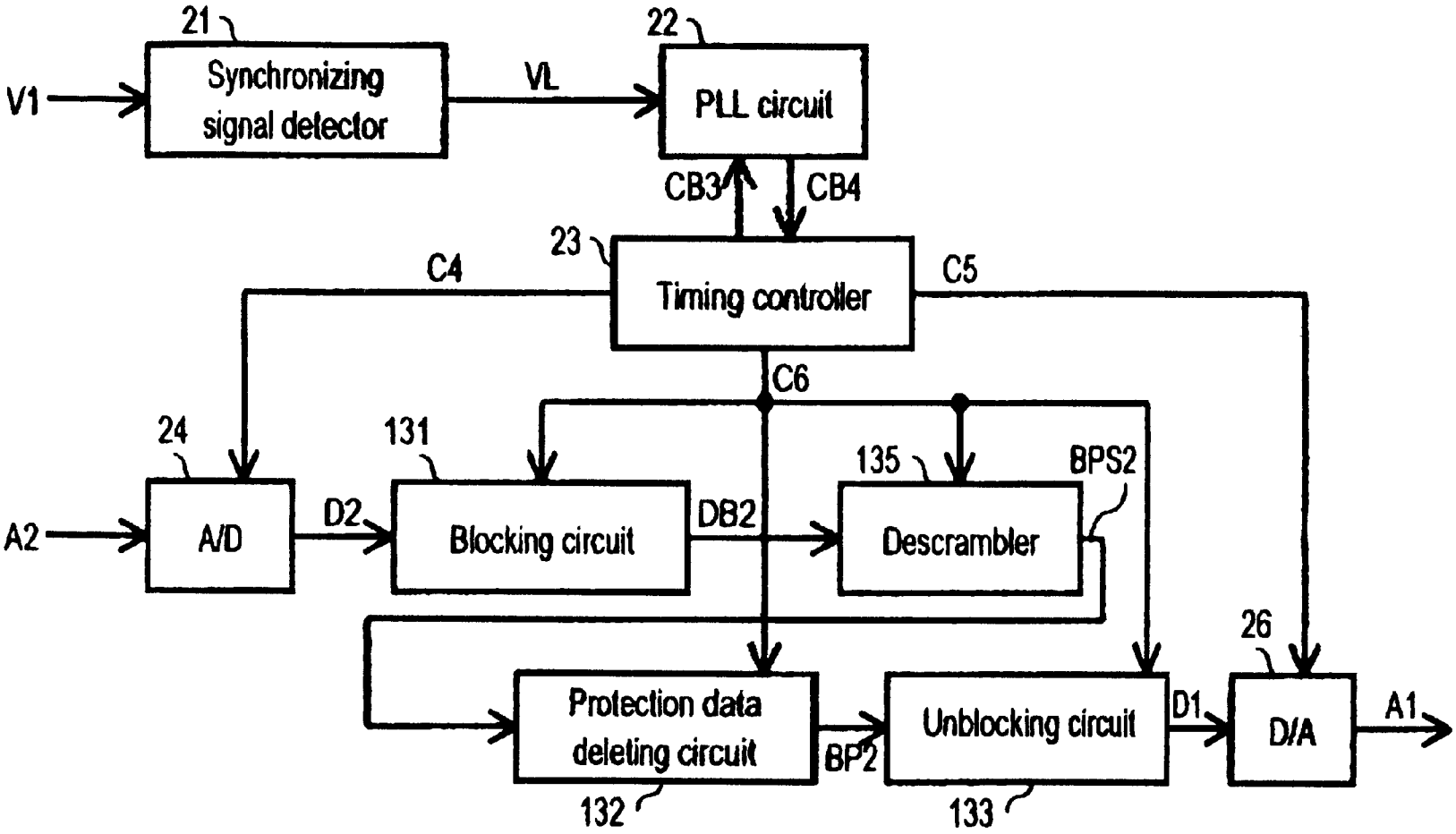
FIG. 13 is a block diagram for an audio signal processing unit in accordance with a sixth exemplary embodiment of the present invention.

FIG. 13 is a block diagram for an audio signal processing unit in a sixth exemplary embodiment of the present invention which reproduces the original audio signal, i.e. descrambling, from the audio signal scrambled through the audio signal processing in an exemplary embodiment of the present invention shown in FIG. 12.

In FIG. 13, the A/D converter 24 receives the analog audio signal A2 scrambled in accordance with the exemplary embodiment shown in FIG. 12. A video signal V1 is supplied to the synchronizing signal detector 21.

The synchronizing signal detector 21 detects the vertical synchronizing signal VL from the video signal V1, and outputs it to the PLL circuit 22. The PLL circuit 22 generates a reference clock signal CB4 for signal processing, by synchronizing a phase comparing clock signal CB3 supplied from the timing controller 23 to the vertical synchronizing signal VL, and supplies it to the timing controller 23. The timing controller 23 outputs a sampling clock signal C4 for A/D conversion, a sampling clock signal C5 for D/A conversion, and a system clock signal C6 for signal processing using the reference clock signal CB4 for signal processing. Here, frequencies of the sampling clock signal C4 for A/D conversion and the sampling clock signal C5 for D/A conversion are respectively set to C4=C2 and C5=C1 against the sampling clock signal C1 for A/D conversion and the sampling clock signal C2 for D/A conversion in the exemplary embodiment shown in FIG. 12.

The A/D converter 24 converts the input scrambled analog audio signal A2 to the scrambled digital audio signal D2 using the sampling clock signal C4 for A/D conversion supplied from the timing controller 23, and outputs the scrambled digital audio signal D2 to a blocking circuit 131.

The scrambled digital audio signal D2 input to the blocking circuit 131 is blocked into digital data of (n+2m) pieces/block in the same way as the exemplary embodiment shown in FIG. 12, to form the scrambled data block DB2, which is supplied to a descrambler 135.

The descrambler 135 switches the order of adjacent odd and even blocks of this scrambled data block DB2 for descrambling, and the descrambled data block BPS2 is supplied to a protection data deleting circuit 132.

The protection data deleting circuit 132 deletes the protection data added to the scrambled data block DB2 in aforementioned scrambling process. More specifically, an m number of digital data is deleted from the top and end of each data block for outputting the data block BP2 after deleting the protection data to a unblocking circuit 133.

The unblocking circuit 133 receives the descrambled data block BP2, and unblocks it to form descrambled and unblocked digital audio signal D1, which is supplied to the D/A converter 26.

The D/A converter 26 converts this input descrambled digital audio signal D1 to the descrambled analog audio signal A1 using the sampling clock signal C5 for D/A conversion supplied from the timing controller 3. Accordingly, the original analog audio signal is regained.

FIGS. 15A to 15E show changes in data array during the abovementioned descrambling process. It may be easier to understand by also referring to FIGS. 14A to 14E which have already been explained in details.

Figures 15A, 15B, 15C, 15D, 15E:
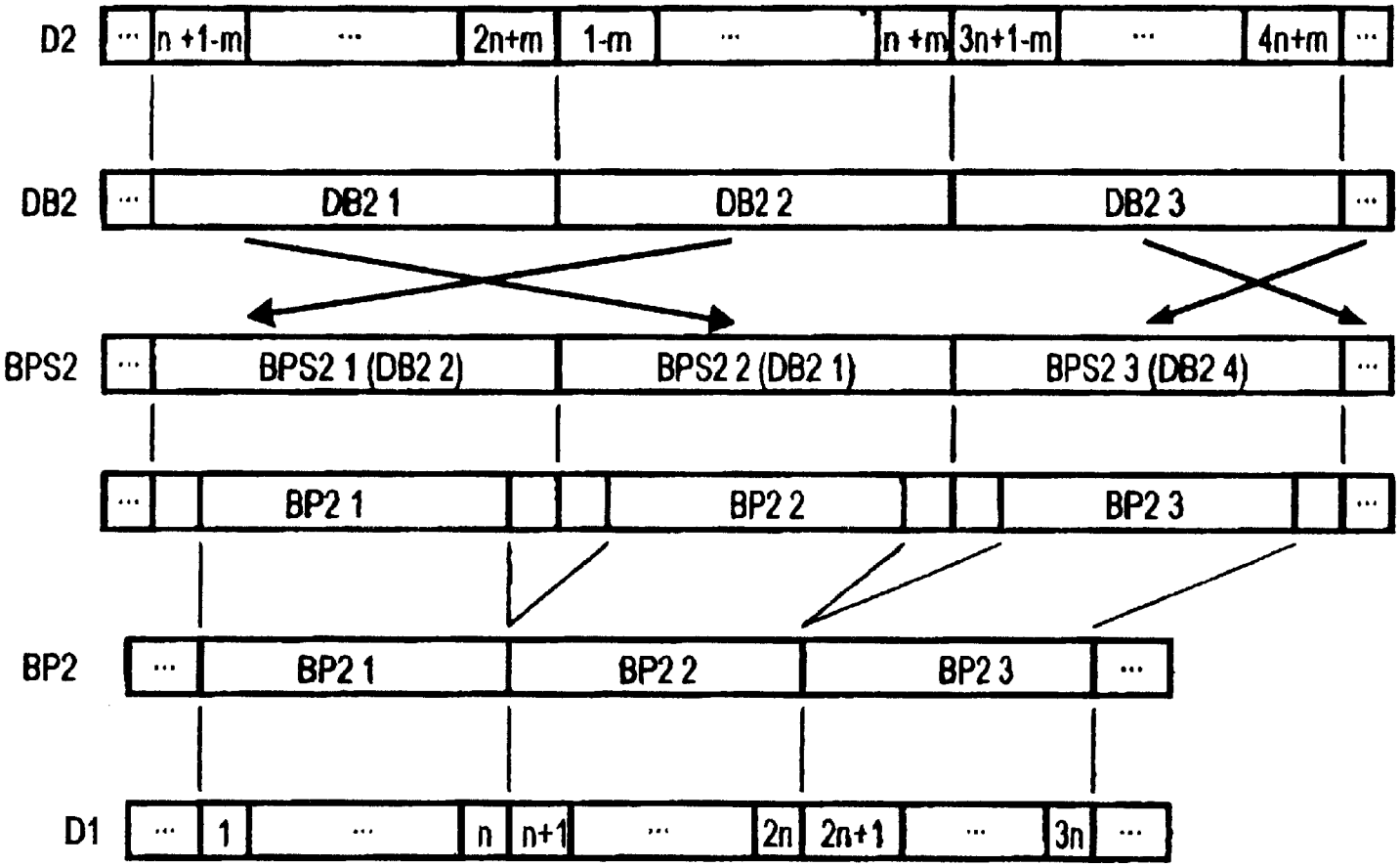
FIG. 15A is data array of the digital audio signal D2.
FIG. 15B is array of the data block DB2.
FIG. 15C is array of the data block BPS2 obtained from descrambling the data block DB2.
FIG. 15D is the data block BP2 obtained by deleting the protection data from the data block BPS2.
FIG. 15E is data array of the digital audio signal D1 obtained by unblocking the data block BP2.

FIG. 15A shows data array of the scrambled digital audio signal D2 with protection data which corresponds to FIG. 14E. FIG. 15B shows the data block DB2 which is the scrambled digital audio signal D2 with protection data shown in FIG. 15A blocked into the unit of (n+2m).

In the descrambling process, the order of the odd block "DB2 1" and its adjacent even block "DB2 2" shown in FIG. 15B is switched to "BPS2 1 (DB2 2)" and "BPS2 1 (DB2 1)" as shown in FIG. 15C. The same shuffling process is implemented for the remaining. This is the opposite process of that shown in FIGS. 14C and 14D.

FIG. 15D is the data block BP2 which is descrambled data block after deleting the protection data. The digital audio signal D1 shown in FIG. 15E is finally obtained by unblocking the data block BP2. Accordingly, the original audio signal is regained by converting this digital audio signal to the analog audio signal.

As explained above, the noise which is likely to occur at the joint between data blocks can be suppressed and deterioration of sound quality due to distortion of signal waveform can be prevented by adding the protection data to the joint of blocks before scrambling and removing this protection data in the descrambling process for reproducing the original audio signal in the signal processing method of the present invention comprising processes of time-base blocking of the audio signal data, and scrambling and descrambling by switching the order of adjacent odd and even blocks.

Addition and deletion of the protection data are actually applied to the digital data. However, to deepen understanding of the above explanation, supplementary explanation is given below with reference to analog waveforms shown in FIGS. 16A and 16B.

Figures 16A, 16B:
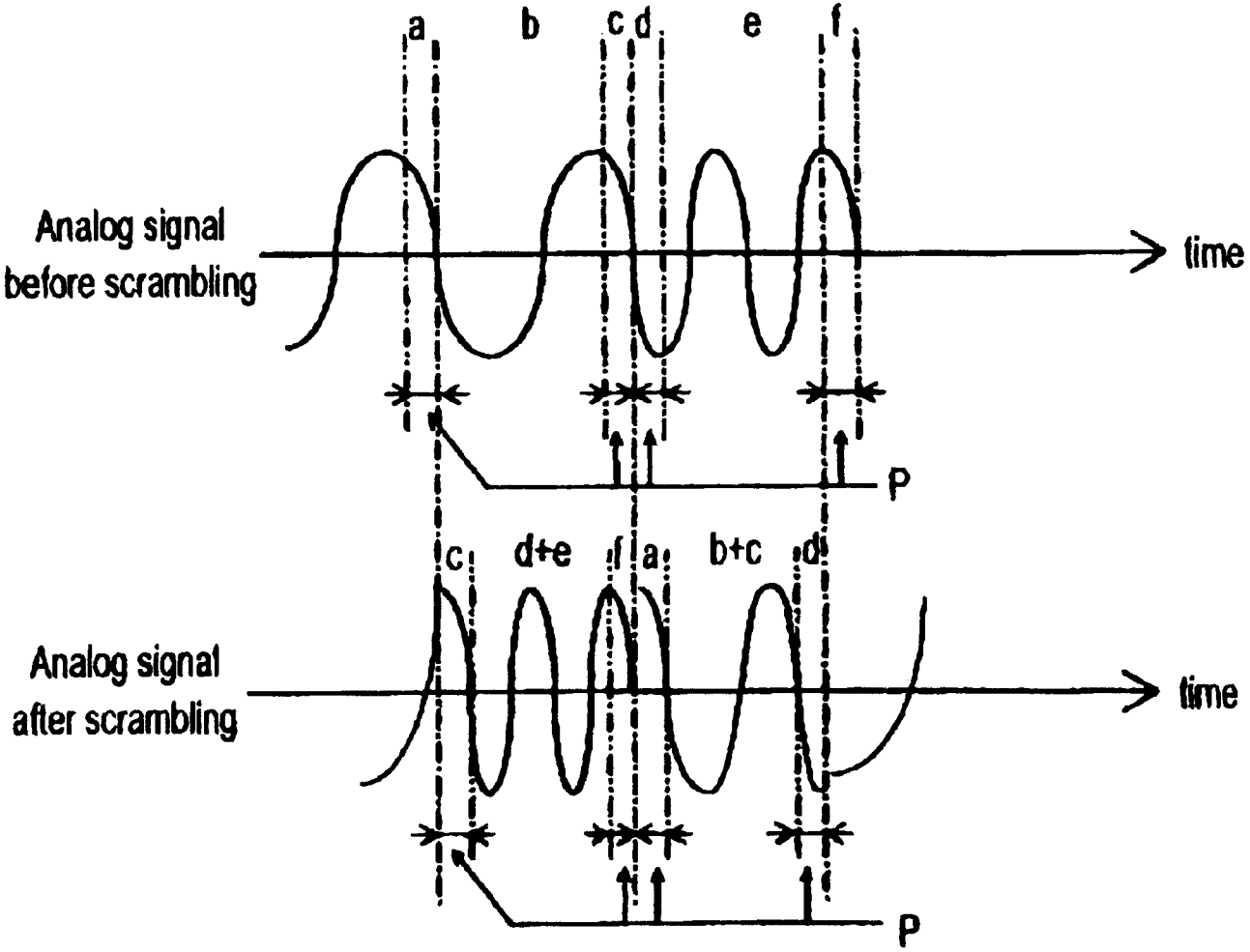
FIG. 16A is an example of the analog audio signal before scrambling for explaining about addition of the protection data.
FIG. 16B is waveform of the analog audio signal of the data with waveform shown in FIG. 15A, scrambled after adding the protection data.

FIGS. 16A and 16B show analog waveforms of the audio signal before and after scrambling. A one-dot-dash-line is a blocking boundary of the original data as explained above. Codes a to f are given to each part of the waveform for the convenience of explanation and to facilitate understanding.

In the waveform of the audio signal before scrambling, shown In FIG. 16A, a part between one-dot-dash-line to the next one-dot-dash-line, such as b+c, is a data block comprising an n number of data (samples). If this part b and c is an odd block, the next part, which is d+e, is its adjacent even block. Comparing with the data block DB1 shown in FIG. 14B, the part b+c corresponds to "DB1 1" in FIG. 14B, for example, and the part d+e in FIG. 16A corresponds to "DB1 2" in FIG. 14B.

Next, the scrambling process is explained. As mentioned in the exemplary embodiment shown in FIG. 12, an m number of audio signal data is added to before and after the data block (DB1) as the protection data, and (n+2m) pieces of data are grouped into one data block. In FIG. 16A, each part of a, c, d, and f which are pointed by the arrow P corresponds to the protection data each comprising an m number of data. In FIG. 16B, the total of parts a, b, c, and d make a data block comprising (n+2m) pieces of data, which corresponds to the aforementioned data block BP1 in which the protection data is added. In the same way, its adjacent data block BP1 is the total of parts c, d, e, and f in FIG. 16B, also comprising (n+2m) pieces of data. Accordingly, the waveform shown in FIG. 16B is obtained by switching waveforms of adjacent odd and even blocks in FIG. 16A. In other words, the analog waveform in FIG. 16B corresponds to FIG. 14D.

It is apparent from the FIG. 16B, which shows a specific waveform, that the protection data exists before and after the one-dot-dash-line indicating the block boundary after the protection data is added. Parts pointed by the arrow P in FIG. 16B are the protection data. The blocking process therefore does not affect waveform to be reproduced although parts pointed by the arrow P corresponding to the protection data are deleted in the descrambling process because the desirable waveform to be reproduced is parts b, c, d, and e in FIG. 16A.

As explained above, the exemplary embodiments of the present invention may not require to separately calculate or prepare the protection data in advance by using the audio signal data (such as parts c and d) also as the protection data as shown in FIG. 16B.

As explained in details in the sixth exemplary embodiment, changes in data and noise which occur where blocks are joined can be prevented by adding the protection data at both ends of each data joint in the processes of blocking the audio signal data in time base and shuffling the order of blocks. As a result, occurrence of noise and deterioration of sound quality can be suppressed in reproduced original analog audio signal.

The present invention also employs a clock pulse generated from a timing signal which synchronizes the digital audio signal digitized from the audio signal of the video signal to the vertical synchronizing signal of the video signal for preventing time deviation in sampling during scrambling and descrambling. Furthermore, the present invention suppresses noise and prevents deterioration of sound quality in the descrambled and reproduced audio signal. Thus, the present invention offers a signal processing unit with smaller circuitry than the signal processing unit of the prior art which shows high practical effect in scrambling and descrambling audio signals.

An audio signal processing method and its device of the present invention are explained with 16 bits/sample as an example. The same effect can be achieved in still other ways. The preferred embodiments described herein are therefore illustrative and not restrictive, the scope of the invention being indicated by the appended claims and all variations which come within the meaning of the claims are intended to be embraced therein.

What is claimed is:

1. An apparatus for digitally processing a plurality of analog signals comprising:

synchronizing signal detection means for extracting a synchronizing signal from a first analog signal of the plurality of analog signals;

timing control means responsive to the synchronizing signal for generating an A/D sampling clock signal, a D/A sampling clock signal;

A/D conversion means responsive to the A/D sampling clock signal for converting a second analog signal of the plurality of analog signals to a digital signal;

blocking means responsive to the system clock signal for dividing the digital signal into a plurality of data blocks;

scrambling means for interchanging two adjacent data blocks of the plurality of data blocks and outputting a scrambled digital signal;

D/A conversion means responsive to the D/A sampling clock signal for converting the scrambled digital signal to an output analog signal;

zero-cross detection means for detecting one of a plurality of zero-cross points of the digital signal closest to a respective boundary of the plurality of data blocks; and data number control means for causing one of the plurality zero-cross points and the respective boundary of the plurality of data blocks to coincide by modifying a plurality of data values defining the digital signal.

2. An apparatus according to claim 1, wherein said data number control means modifies the plurality of data values defining the digital signal by one of a) inserting digital data and b) deleting digital data.

3. An apparatus for digitally processing a plurality of analog signals, comprising:

synchronizing signal detection means for extracting a synchronizing signal from a first analog signal of the plurality of analog signals;

timing control means responsive to the synchronizing signal for generating an A/D sampling clock signal, a D/A sampling clock signal, and a system clock signal;

A/D conversion means responsive to the A/D sampling clock signal for converting a second analog signal of the plurality of analog signals to a digital signal;

blocking means responsive to the system clock signal for dividing the digital signal into a plurality of data blocks;

protection data addition means for adding digital data before and after each of the plurality of data blocks;

scrambling means for interchanging two adjacent data blocks of the plurality of data blocks and outputting a first scrambled digital signal;

unblocking means for converting the first scrambled digital signal to a second scrambled digital signal by removing the plurality of data blocks;

D/A conversion means responsive to the D/A sampling clock signal for converting the second scrambled digital signal to an output analog signal;

a phase-locked-loop responsive to the synchronizing signal for generating a reference clock signal by synchronizing the synchronizing signal and a phase comparing clock signal, wherein said timing control receives the reference clock signal.

4. An apparatus according to claim 3, wherein a first frequency associated with the A/D sampling clock signal is greater than a second frequency associated with the D/A sampling clock signal.

5. An apparatus for digitally processing a plurality of analog signals, comprising:

synchronizing signal detection means for extracting a synchronizing signal from a first analog signal of the plurality of analog signals;

timing control means responsive to the synchronizing signal for generating an A/D sampling clock signal, a D/A sampling clock signal, and a system clock signal;

A/D conversion means responsive to the A/D sampling clock signal for converting a scrambled analog signal of the plurality of analog signals to a scrambled digital signal;

blocking means responsive to the system clock signal for dividing the scrambled digital signal into a plurality of data blocks;

descrambling means for interchanging two adjacent data blocks of the plurality of data blocks and outputting a descrambled digital signal;

protection data deletion means for deleting digital data from each of the plurality of data blocks;

unblocking means for converting the first scrambled digital signal to a second descrambled digital signal by removing the plurality of data blocks;

D/A conversion means responsive to the D/A sampling clock signal for converting the second descrambled digital signal to an output analog signal;

a phase-locked-loop responsive to the synchronizing signal for generating a reference clock signal by synchronizing the synchronizing signal and a phase comparing clock signal, wherein said timing control means receives the reference clock signal.

6. An apparatus according to claim 5, wherein a first frequency associated with the A/D sampling clock signal is greater than a second frequency associated with the D/A sampling clock signal.

7. A method of processing a digital signal comprising the steps of:

generating a clock signal having a fixed blocking time period;

dividing the digital signal into a plurality of data blocks synchronously with the clock signal;

interchanging two adjacent data blocks of the plurality of data blocks;

measuring a zero-cross time period of the digital signal;

calculating a time difference between the zero-cross time period and the fixed blocking time period;

inserting data into the digital signal if the time difference is negative; and deleting data from the digital signal if the time difference is positive.

* * * * *